US007798590B2

(12) United States Patent
Snyder

(10) Patent No.: US 7,798,590 B2
(45) Date of Patent: Sep. 21, 2010

(54) PRINTER HAVING USER PROFILES FOR CONSERVING POWER CONSUMPTION

(75) Inventor: Trevor James Snyder, Newberg, OR (US)

(73) Assignee: Xerox Corporation, Norwalk, CT (US)

( * ) Notice: Subject to any disclaimer, the term of this patent is extended or adjusted under 35 U.S.C. 154(b) by 987 days.

(21) Appl. No.: 11/594,414

(22) Filed: Nov. 8, 2006

(65) Prior Publication Data

US 2008/0107443 A1 May 8, 2008

(51) Int. Cl.
*B41J 29/38* (2006.01)

(52) U.S. Cl. ..... 347/14; 347/19

(58) Field of Classification Search ..... 347/14
See application file for complete search history.

(56) References Cited

U.S. PATENT DOCUMENTS

| | | | | |
|---|---|---|---|---|
| 5,657,257 | A | 8/1997 | Lee | |
| 5,900,026 | A | 5/1999 | Ryu | |
| 5,974,559 | A | 10/1999 | Bannai | |
| 6,011,383 | A | 1/2000 | Dean et al. | |
| 6,243,548 | B1 | 6/2001 | Hebert et al. | |
| 6,260,111 | B1 | 7/2001 | Craig et al. | |
| 6,594,767 | B1 | 7/2003 | Wiley et al. | |
| 6,713,728 | B1 | 3/2004 | Justice et al. | |
| 6,715,088 | B1 | 3/2004 | Togawa | |
| 6,724,493 | B1 | 4/2004 | Maruta et al. | |
| 6,766,223 | B1 * | 7/2004 | Motoyama | 700/286 |
| 6,912,664 | B2 | 6/2005 | Ranganathan et al. | |
| 6,928,564 | B2 | 8/2005 | Tada et al. | |
| 7,013,204 | B1 | 3/2006 | Motoyama | |
| 7,082,373 | B2 | 7/2006 | Holle | |
| 2001/0047490 | A1 | 11/2001 | Barbee | |
| 2002/0184519 | A1 * | 12/2002 | Wadley | 713/200 |
| 2004/0169706 | A1 * | 9/2004 | Slotto et al. | 347/85 |
| 2006/0173582 | A1 | 8/2006 | Motoyama | |

* cited by examiner

*Primary Examiner*—Matthew Luu
*Assistant Examiner*—Brian J Goldberg
(74) *Attorney, Agent, or Firm*—Maginot, Moore & Beck LLP

(57) ABSTRACT

The system and process enable a printer to more realistically apprise whether internal components require additional power in order for them to be ready for use. The process includes detecting a user operating a device that is coupled to a printing device and setting a higher power consumption level for the printing device in response to the detection of the user operation. This process may be enhanced by compiling a printing device usage profile for each user of the printing device and determining whether the usage profile indicates the power consumption level is to be increased in response to the detection of the user operation.

10 Claims, 3 Drawing Sheets

PRINTER HAVING USER PROFILES FOR CONSERVING POWER CONSUMPTION

CROSS-REFERENCED APPLICATION

This application cross-references co-pending patent application bearing Ser. No. 11/594,397 which is entitled "System And Method For Reducing Power Consumption In An Imaging Device" and was filed on even date herewith. This application is owned by the assignee of the present application and is incorporate by reference in its entirety.

TECHNICAL FIELD

This disclosure relates generally to printers having different levels of power consumption and, more particularly, to solid ink printers, which require increased power for melting solid ink and maintaining the melted ink in liquid state.

BACKGROUND

Many printers, scanners, and copiers are designed with operational modes that consume power at different levels. When the devices are not being used, they typically operate in a power saving mode. In this mode, the devices draw enough power to support low voltage electronics that are awaiting actuation for operation of the device for printing, scanning, or copying. In response to a user touching or depressing an actuating surface, the device controller activates components that draw additional power in preparation for use of the device. For example, a scanner may warm up a scanning lamp and a printer or copier may warm a fuser roll. Once the device has been used, it may remain at the high power consumption level to maintain one or more components within an operational temperature range. Maintaining components with an operational temperature range helps reduce the number of cycles experienced by the components and helps preserve their operational life. Upon expiration of a monitoring period without further use, the device returns to the power saving mode.

Solid ink and laser printers, in particular, have some power intensive functions to perform in preparation for being ready to print. For example, the fuser in a laser printer typically operates in a temperature range of approximately 150 to 200° C. In another example, a print head in a solid ink printer operates in the range of approximately 140 to 150° C. and an imaging drum operates in a range of approximately 60 to 65° C. In standby mode, a solid ink printer conserves energy by reducing the print head and drum temperature. The print head temperature is held at a temperature slightly above the solidifying temperature for the melted ink. While this mode of operation reduces the electrical power consumption of the solid ink printer, it does not necessarily reduce power consumption that is comparable with printing technologies that do not require heating of the ink to maintain it in a liquid state. The optimal holding temperature from a customer perspective, however, may be higher in order to avoid the time waiting for the print head or imaging drum to achieve operating temperature. Therefore, improvements in printer hardware and software are desirable to enable low power consumptions levels that meet current and future government standards while providing prompt response times for customers.

SUMMARY

In order to balance power consumption of printers with customer usage needs, a new printer and control process have been developed that adjust power consumption levels in response to detection of user device operation. The system and process enable a printer to more realistically apprise whether internal components require additional power in order for them to be ready for use. The process includes detecting operation of a user device that is coupled to a printing device and setting a power consumption level for the printing device in response to the detection of the user device operation. This process may be enhanced by compiling a printing device usage profile for each user of the printing device and determining whether the usage profile indicates the power consumption level is to be increased in response to the detection of the user operation.

A system that implements the power control process includes a printer driver for generating a user detected signal and a printing device that sets a power consumption level for the printing device in response to receipt of the user detected signal. The printer may also collect historical data regarding usage of the printer and store the data in association with each user device coupled to the printer. The printing device controller may determine to adjust the power consumption level for the printing device by comparing an availability factor computed from the historical data for a user device to a power level parameter.

BRIEF DESCRIPTION OF THE DRAWINGS

The foregoing aspects and other features of a printer implementing a power conservation process are explained in the following description, taken in connection with the accompanying drawings, wherein.

DETAILED DESCRIPTION

Figure 1:
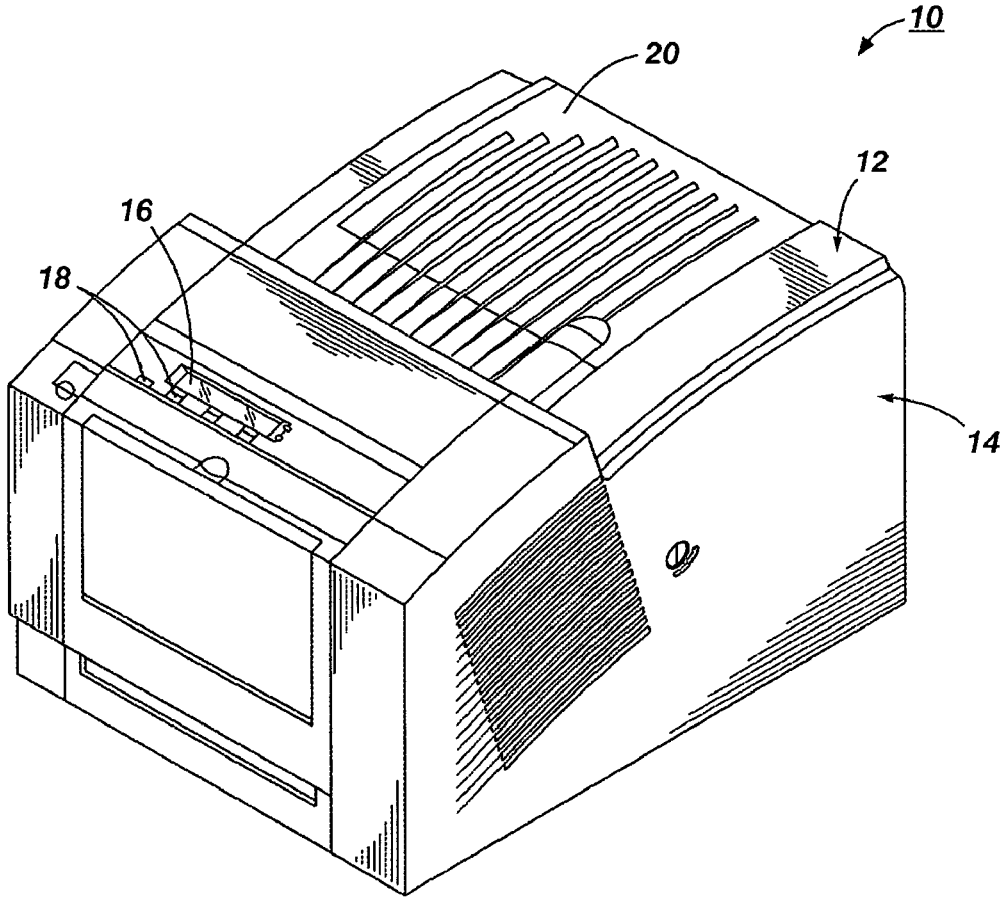
FIG. 1 is a perspective view of a solid ink printer that detects user operation of a device coupled to the printer to alter its power consumption mode.

Referring to FIG. 1, there is shown a perspective view of an ink printer 10 that implements a solid ink offset print process. The reader should understand that the embodiment discussed herein may be implemented in many alternate forms and variations and is not limited to solid ink printers only. In addition, any suitable size, shape or type of elements or materials may be used.

FIG. 1 shows a solid ink printer 10 that includes an outer housing having a top surface 12 and side surfaces 14. A user interface display, such as a front panel display screen 16, displays information concerning the status of the printer, and user instructions. Buttons 18 or other control elements may be used to select or define parameters for controlling operation of the printer. The buttons may be located adjacent the user interface display 16 or they may be provided at other locations on the printer. Additionally or alternatively, buttons 18 may be implemented as radio buttons on the display 16. In such an embodiment, the user display 16 also incorporates a touch screen to provide input data to the printer controller.

An ink feed system delivers ink to an ink jet printing mechanism (not shown) that is contained inside the housing. The ink feed system may be accessed through the hinged ink access cover 20 that opens to reveal keyed openings and feed channels having an ink load linkage element. The ink access cover and the ink load linkage element may operate as described in U.S. Pat. No. 5,861,903 for an Ink Feed System, issued Jan. 19, 1999 to Crawford et al. In one embodiment, the ink jet printing mechanism ejects ink onto a rotating intermediate imaging member and the image is transferred to a sheet of media. In another embodiment, the ink jet printing mechanism ejects the ink directly onto a media sheet.

Figure 2:
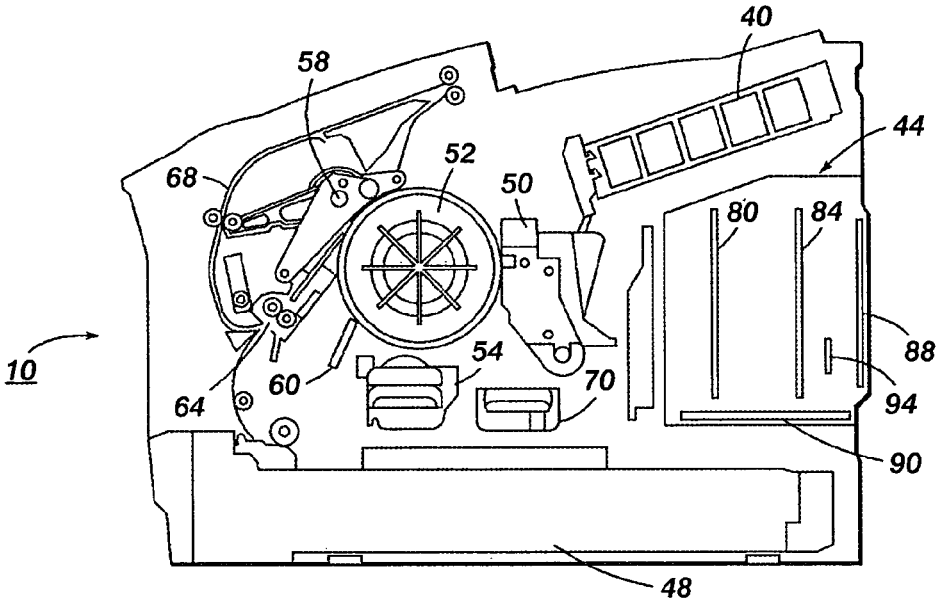
FIG. 2 is a side view of the printer shown in FIG. 1 that depicts the major subsystems of the solid ink printer.

As shown in FIG. 2, one embodiment of the ink printer 10 may include an ink loading subsystem 40, an electronics module 44, a paper/media tray 48, a print head 50, an intermediate imaging member 52, a drum maintenance subsystem 54, a transfer subsystem 58, a wiper subassembly 60, a paper/media preheater 64, a duplex print path 68, and an ink waste tray 70. In brief, solid ink sticks are loaded into ink loader 40 through which they travel to a melt plate located at the end of loader 40. At the melt plate, the ink stick is melted and the liquid ink is diverted to a reservoir in the print head 50. The ink is ejected by piezoelectric elements through apertures in plates to form an image on a liquid layer that is supported by the intermediate imaging member 52 as the member rotates. An intermediate imaging member heater is controlled by a controller to maintain the imaging member within an optimal temperature range for generating an ink image and transferring it to a sheet of recording media. A sheet of recording media is removed from the paper/media tray 48 and directed into the paper pre-heater 64 so the sheet of recording media is heated to a more optimal temperature for receiving the ink image. A synchronizer delivers the sheet of the recording media so its movement between the transfer roller in the transfer subsystem 58 and the intermediate image member 52 is coordinated for the transfer of the image from the imaging member to the sheet of recording media.

A duplex image includes a first image that is transferred from the intermediate imaging member onto a first side of a recording media sheet followed by a second image that is transferred from the intermediate imaging member onto the reverse side of the recording media sheet to which the first image was transferred. If a duplex image is to be transferred to the reverse side of a sheet, the reverse side of the sheet is presented to the intermediate imaging member by directing the sheet through the duplex print path 68 after it has passed through the transfer roller for the transfer of the first image. As the transfer process is repeated, the second image is transferred from the intermediate imaging member 52 to the reverse side of the sheet imaged during the previous transfer cycle. The sheet bearing the duplex image is then ejected by ejection rollers and deposited in the output tray.

The operations of the ink printer 10 are controlled by the electronics module 44. The electronics module 44 includes a power supply 80, a main board 84 with a controller, memory, and interface components (not shown), a hard drive 88, a power control board 90, and a configuration card 94. The power supply 80 generates various power levels for the various components and subsystems of the printer 10. The power control board 90 includes a controller and supporting memory and I/O circuits to regulate these power levels. The configuration card contains data in nonvolatile memory that defines the various operating parameters and configurations for the components and subsystems of the printer 10. The hard drive stores data used for operating the ink printer and software modules that may be loaded and executed in the memory on the main board 84. The main board 84 includes the controller that operates the printer 10 in accordance with the operating program executing in the memory of the main board 84. The controller receives signals from the various components and subsystems of the printer 10 through interface components on the main board 84. The controller also generates control signals that are delivered to the components and subsystems through the interface components. These control signals, for example, drive the piezoelectric elements to expel ink through print head apertures to form the image on the imaging member 52 as the member rotates past the print head. One control signal generated by the controller in FIG. 2 is a power level adjustment signal.

Figure 3:
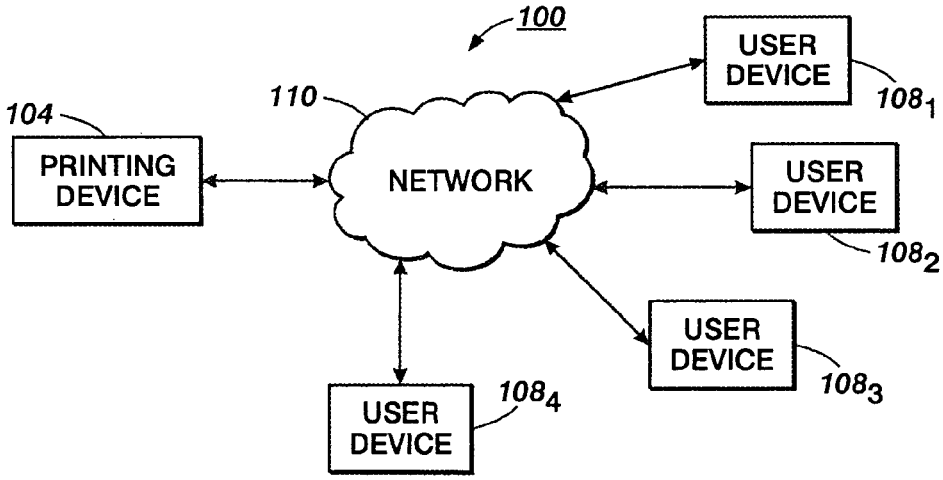
FIG. 3 is a block diagram of a system incorporating the printer of FIG. 2.

As shown in FIG. 3, a system 100 may include a printing device 104, such as, for example, the printer described above, and a plurality of user devices $\mathbf{108}_1$ to $\mathbf{108}_4$, such as, for example, personal computers, that are coupled together through a network 110. The personal computers include printer driver software that has been modified to generate one or more signals regarding operation of the user device. These signals are received by the printing device 104 and used to determine whether the printing device 104 needs to change its power consumption level.

In one embodiment, a printer driver installed on a printing device $\mathbf{108}_1$ to $\mathbf{108}_4$ detects a user operating the device. This detection may be in the form of detecting mouse movement, keyboard strokes, software application launches, or any other detectable user interaction with the device. Upon detection of operation of one of the devices $\mathbf{108}_1$ to $\mathbf{108}_4$, the driver in that device generates a user detected signal and sends the signal over the network 110 to the printing device 104. The signal is delivered in a data message or the like to the communication interface of the printing device 104. The controller of the printing device 104 processes the user detected signal and generates a signal for the power controller to couple electrical power to components requiring warm up or the like. For example, the power controller may couple a fuser roll or a melt plate to power. As a result, the printing device begins to consume more electrical power. One advantage of this change is that the printing device is more likely to ready for performing a printing function when the user sends a print job to the printing device over the network.

Figure 4:
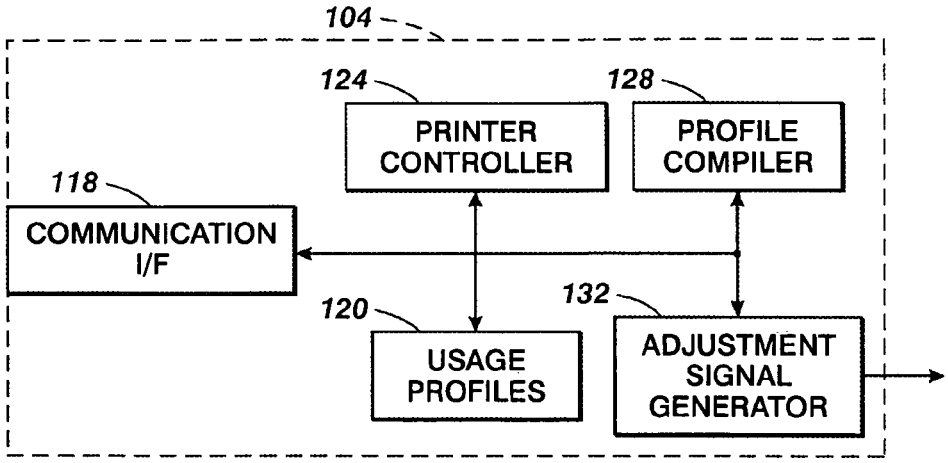
FIG. 4 is a block diagram of an alternative embodiment of the printer shown in FIG. 2.

In another embodiment of a printing device 104 shown in FIG. 4, the printing device 104 includes a communication interface 118, a usage profile memory 120, a printer controller 124, a profile compiler 128, and an adjustment signal generator 132. The communication interface is a known component that manages and implements communication with devices over the network 110. The printer controller 124 processes the user detected signals received from the user devices 108 through the communication interface 118 to compile a usage profile for each user on the network. These usage profiles are stored in the usage profile memory 120. The printer controller also determines whether a user detected signal requires adjustment of the power consumption level for the printing device 104. The printer controller 124 performs the compilation function and the power consumption level adjustment function by executing computer program instructions that are represented by the profile compiler module 128 and the adjustment signal generator module 132. These modules are instructions programmed into a non-volatile memory for execution by the processor that implements the printer controller 124. The printer controller 124 may incorporate these modules as program code in an application specific integrated circuit (ASIC) or in program memory coupled to the printer controller 124 through a bus. Other methods of controlling the operations of the printer controller to implement these functions may be used as well.

In the embodiment of FIG. 4, usage profiles are stored in a memory 120 coupled to the printer controller 124. The profile compiler 128 of the printer controller 124 compiles the usage profiles from data messages received from the user devices 108$_1$ to 108$_4$. The data messages received from the user devices 108$_1$ to 108$_4$ contain the user detected signal and an identifier for the device coupled to the printing device. The message may also contain a time of detection that was generated by the printer driver or the communication interface 118 of the printing device 104 may generate a timestamp for the message that the profile compiler 128 uses for evaluation. The usage profiles are used by the adjustment signal generator 132 of the printer controller 124 to determine whether the power consumption level for the printing device 104 requires adjustment. During the time period required for compiling a usage profile for a user device, the printing device 104 may respond as described above. Once an appropriate number of user activities have been received and compiled into a usage profile for a user device, the printer adjustment signal generator utilizes the usage profiles to determine the power consumption level required for the printing device 104.

More specifically, the printer driver in a user device 104 may generate user detected signals following expiration of a watchdog time period. During the watchdog time period, the printer driver continues to monitor user operations, but does not generate a user detected signal. Instead, the watchdog time period is renewed upon detection of another user operation so the printer driver only generates a user detected signal in response to the expiration of the watchdog time period and a new user operation. Alternatively, the printer driver may generate a user inactive signal in response to the expiration of the watchdog time period. A subsequent user operation results in the printer driver generating another user detected signal.

Figure 5:
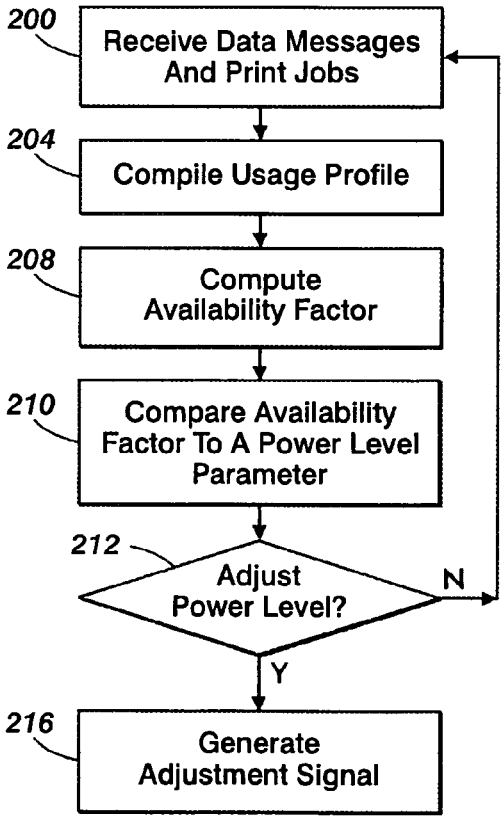
FIG. 5 is a flow diagram of a process that may be implemented by the controller shown in FIG. 4.

A process that may be implemented by the printer controller 124 is shown in FIG. 5. The profile compiler 128 of the printing device controller 124 collects the user detected data messages and print jobs from the printer drivers in the user devices 108$_1$ to 108$_4$ (block 200) and compiles them into usage profiles, one for each user device (block 204). This compilation may include measuring a parameter related to the detection of user device operation and the frequency or timing of print jobs from the user device. That is, a usage profile for a user device contains a history of the user device's usage of the printing device. These data may be used to compute an availability factor associated with the user device (block 208). For example, the time differences between a user detected signal and the next print job received may be computed and stored in the usage profile. These times may then be mean averaged to compute an availability factor that corresponds to the average time between a user detected signal and a print job being received. The availability factor, for example, the mean average time, may then be compared to a power level parameter (block 210) to determine whether the power level is to be adjusted or not (block 212). If the power level requires adjustment, the adjustment signal generator 132 of the printer controller 124 generates a signal for the power controller to change the power level for the printing device 104 (block 216). For example, the power level parameter may be a printing device ready time period and the printing device ready time period may correspond to the length of time required for heating a fuser roll or melting an adequate quantity of ink for supporting a print job. The comparison in this example is implemented with a computation of a differential time between the two values. If the length of the ready time period is equal to or greater than the computed average in the example being described, then a user detected signal should result in an increase in the power consumption level to anticipate a print job arriving by the average time period. On the other hand, if the comparison indicates no adjustment is necessary, then the printer controller continues to update the user profiles and to monitor the differential between the availability factor and the power level parameter until the process determines that the power consumption level requires adjustment (block 212). Continuing the example, if the length of time for the printing component preparation is less than the availability factor corresponding to the computed average, then the printer controller may time a period corresponding to the difference between the two time periods before altering the power consumption level for the printing device.

Implementing the method shown in FIG. 5 is less likely to increase the power level consumption without a reasonable probability that a print job is received within the time period represented by the availability factor. While some risk exists that a print job is received before the printing device is fully prepared to perform the job, this risk is more acceptable because the time required for completion of preparation for the printing device is less than if the preparation commenced in response to receipt of a print job.

Once a printing device that responds to user detected signals from user devices is installed in a facility and the corresponding printer drivers installed in the user devices, the printing device 104 commences preparation of the printing device 104 for performing print jobs before print jobs are sent to the printing device. Although some print jobs may arrive before preparation of the printing device is complete, the time to complete the preparation is less than the users have typically encountered. Thus, users perceive the printing device has having a shorter preparation cycle and frustration with waiting for the printing device to complete its preparation is reduced. Generally speaking, the printing device is more likely to be ready for print jobs when a user having a history of greater usage volume or more users are detected on the network. Conversely, as the numbers of users on the network decrease or as the expected print volume from the users on the network decrease, the printing device is more likely to enter its power saving mode. Thus, the structure and method described above tailor the power consumption of the printing device to the likely demand for print job service present on the network.

Those skilled in the art will recognize that numerous modifications can be made to the specific implementations described above. For example, those skilled in the art will recognize that while one embodiment has been discussed with reference to a mean average availability factor, the availability factor may be computed with a weighted average to produce a more statistically significant availability factor. Likewise, demand parameters other than time may be used for computation of the availability factor. Also, while the embodiments above have been described with reference to a solid ink offset printer, the initiation of a printing device preparation cycle in response to detection of user device operation may be performed with other types of printers and other types of user devices. Therefore, the following claims are not to be limited to the specific embodiments illustrated and described above. The claims, as originally presented and as they may be amended, encompass variations, alternatives, modifications, improvements, equivalents, and substantial equivalents of the embodiments and teachings disclosed herein, including those that are presently unforeseen or unappreciated, and that, for example, may arise from applicants/patentees and others.

I claim:

1. A solid ink printer comprising:

an ink loading subsystem for receiving solid ink and delivering the solid ink to a melt plate for converting the solid ink to liquid ink;

a print head for receiving the liquid ink;

an intermediate imaging member that rotates in proximity to the print head for receiving liquid ink ejected from the print head;

a transfer subsystem for transferring the ink from the intermediate imaging member onto a sheet of media; and an electronics module for controlling operation of the solid ink printer, the electronics module further comprising:

a communication interface for receiving user detected signals, user detected data messages, and print jobs from user devices coupled to the solid ink printer, the user detected signal indicating user operation of a user device, and a printer controller for setting a power consumption level for the solid ink printer in response to receipt of the user detected signal, the printer controller including:

a profile compiler configured to compile usage profiles from user detected signals and data messages received from user devices coupled to the solid ink printer, to measure parameters related to detection of user device operation and the print jobs received from user devices, to compute an availability factor for a user device coupled to the solid ink printer from the measured parameters related to the detection of user device operation and the print jobs received from user devices;

an adjustment signal generator for comparing a computed availability factor for a user device to a power level parameter to determine whether to adjust the power level consumption; and a memory for storing a usage profile for each user device coupled to the printing device.

2. The solid ink printer of claim 1 wherein the adjustment signal generator compares a mean average time between user device operation and receipt of a print job to a printing device ready time period.

3. The solid ink printer of claim 1 wherein the adjustment signal generator compares a weighted average time between user device operation and receipt of a print job to a printing device ready time period.

4. The solid ink printer of claim 1 wherein the adjustment signal generator computes a differential time period between the availability factor and the power level parameter and sets the power consumption level upon the expiration of the computed differential time period.

5. A solid ink printer comprising:

an ink loading subsystem configured to receive solid ink and deliver the solid ink to a melt plate for conversion of the solid ink to liquid ink;

a print head configured to receive liquid ink;

an intermediate imaging member that rotates in proximity to the print head to receive liquid ink ejected from the print head;

a transfer subsystem configured to transfer ink from the intermediate imaging member onto a sheet of media; and an electronics module configured to control operation of the solid ink printer, the electronics module further comprising:

a communication interface for receiving user detected signals, user detected data messages, and print jobs from user devices coupled to the solid ink printer, the user detected signals indicating user operation of a user device, and a printer controller configured to set a power consumption level for the solid ink printer in response to receipt of a user detected signal, the printer controller including:

a profile compiler configured to compile usage profiles from the user detected signals and user detected data messages received from user devices coupled to the solid ink printer, the printer controller being configured to set the power consumption level for the solid ink printer with reference to the usage profiles compiled from the user detected signals and the user detected data messages; and a memory for storing a usage profile for each user device coupled to the printing device.

6. The solid ink printer of claim 5, the profile compiler being further configured to measure a parameter related to detection of user device operation and the print jobs received from a user device and to compute an availability factor for a user device coupled to the solid ink printer from the measured parameters related to detection of user device operation and the print jobs received from the user device.

7. The solid ink printer of claim 6 further comprising:

an adjustment signal generator configured to compare the computed availability factor to a power level parameter, the printer controller being further configured to set the power consumption level for the solid ink printer with reference to the comparison of the computed availability factor to the power level parameter.

8. The solid ink printer of claim 7 wherein the adjustment signal generator compares a mean average time between user device operation and receipt of a print job to a printing device ready time period.

9. The solid ink printer of claim 7 wherein the adjustment signal generator compares a weighted average time between user device operation and receipt of a print job to a printing device ready time period.

10. The solid ink printer of claim 7 wherein the adjustment signal generator computes a differential time period between the availability factor and the power level parameter, and the printer controller sets the power consumption level upon the expiration of the computed differential time period.

* * * * *